US008926039B2

(12) United States Patent
Furuta

(10) Patent No.: US 8,926,039 B2
(45) Date of Patent: Jan. 6, 2015

(54) PRINTING DEVICE AND PRINTING METHOD

(71) Applicant: Seiko Epson Corporation, Tokyo (JP)

(72) Inventor: Tatsuo Furuta, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/196,535

(22) Filed: Mar. 4, 2014

(65) Prior Publication Data

US 2014/0292849 A1 Oct. 2, 2014

(30) Foreign Application Priority Data

Mar. 28, 2013 (JP) ..... 2013-069307

(51) Int. Cl.
*B41J 29/38* (2006.01)
*B41J 2/07* (2006.01)

(52) U.S. Cl.
CPC ..... *B41J 2/07* (2013.01)
USPC ..... 347/9; 347/14

(58) Field of Classification Search
CPC ..... B41J 2/205; B41J 2/07; B41J 2/21
USPC ..... 347/5, 9, 14, 19
See application file for complete search history.

(56) References Cited

U.S. PATENT DOCUMENTS 7,300,137 B2 11/2007 Yamanaka et al.
7,303,260 B2 12/2007 Osada et al.
7,699,436 B2 4/2010 Shibata et al.
7,874,639 B2 1/2011 Nagata et al.
8,231,203 B2 7/2012 Akama et al.
8,287,089 B2 * 10/2012 Kimura et al. ..... 347/40

FOREIGN PATENT DOCUMENTS

JP 2002-113852 A 4/2002
JP 2006-076010 A 3/2006
JP 2006-076011 A 3/2006
JP 2006-192892 A 7/2006
JP 2007-144711 A 6/2007
JP 2010-046903 A 3/2010
JP 2010-046904 A 3/2010
JP 2010-162873 A 7/2010

* cited by examiner

*Primary Examiner* — Juanita D Jackson

(74) *Attorney, Agent, or Firm* — Global IP Counselors, LLP

(57) ABSTRACT

In a printing device, printing is performed by relatively moving a nozzle array for ejecting a liquid droplet with respect to a print medium, a resolution by a nozzle pitch of the nozzle array is lower than a target print resolution, and between liquid droplets ejected by a single nozzle array, liquid droplets are ejected from the same or another nozzle array to attain the target print resolution. Each of a plurality of nozzles in the single nozzle array is printable by changing an ejection density by applying a preset rate thinning when ejecting liquid droplets by relatively moving with respect to the print medium. The printing device is provided with a print control part configured to perform printing by dividing the single nozzle array into a plurality of nozzle blocks and determining the ejection density in every nozzle blocks.

12 Claims, 8 Drawing Sheets

GOING PASS
→ EJECTION PERIOD
RETURNING PASS
→ EJECTION PERIOD
COMPLETED IMAGE
#1 FIRST
#2 FIRST
#3 FIRST
#4 FIRST
#5 FIRST
#6 SECOND
#7 SECOND
#8 SECOND
#9 SECOND
#10 SECOND
#11 FIRST
#12 FIRST
#13 FIRST
#14 FIRST
#15 FIRST
#16 SECOND
#17 SECOND
#18 SECOND
#19 SECOND
#20 SECOND
#1 SECOND
#2 SECOND
#3 SECOND
#4 SECOND
#5 SECOND
#6 FIRST
#7 FIRST
#8 FIRST
#9 FIRST
#10 FIRST
#11 SECOND
#12 SECOND
#13 SECOND
#14 SECOND
#15 SECOND
#16 FIRST
#17 FIRST
#18 FIRST
#19 FIRST
#20 FIRST
75.0%
75.0%
75.0%

PRINTING DEVICE AND PRINTING METHOD

CROSS-REFERENCE TO RELATED APPLICATIONS

This application claims priority to Japanese Patent Application No. 2013-069307 filed on Mar. 28, 2013. The entire disclosure of Japanese Patent Application No. 2013-069307 is hereby incorporated herein by reference.

BACKGROUND

1. Technical Field

The present invention relates to a printing device and a printing method which may cause uneven print results due to ripple marks.

2. Related Art

In recent years, in a printing device in which a nozzle arrangement is high in density and printing is performed by moving a print head at a relatively high speed, it is known that uneven print results due to ripple marks may occur. Japanese Unexamined Laid-open Patent Application Publication No. 2006-192892 discloses a printing device that controls such ripple marks.

In the printing device disclosed by the document, a nozzle array is in a zigzag alignment and a resolution by a nozzle pitch of a print head is set to 1,200 dpi which is a resolution at the time of final printing (hereinafter referred to as "target print resolution"). When printing by plural passes, printing is performed by interpolating an image thinned at one pass at another pass. While eliminating the ripple marks by the thinning, thinning is performed alternately at high and low thinning rates along the orientation direction of the nozzle array.

SUMMARY

In the aforementioned conventional printing device, regardless of using a high density print head, while performing thinning to prevent deterioration due to ripple marks, a thinned image is interpolated at plural passes. These results in a deteriorated print speed, and therefore merits could be less expected.

The present invention solves unevenness of the print result due to ripple marks.

In a printing device according to one aspect, printing is performed by relatively moving a nozzle array for ejecting a liquid droplet with respect to a print medium, a resolution by a nozzle pitch of the nozzle array is lower than a target print resolution, and between liquid droplets ejected by a single nozzle array, liquid droplets are ejected from the same or another nozzle array to attain the target print resolution. Each of a plurality of nozzles in the single nozzle array is printable by changing an ejection density by applying a preset rate thinning when ejecting liquid droplets by relatively moving with respect to the print medium. The printing device is provided with a print control part configured to perform printing by dividing the single nozzle array into a plurality of nozzle blocks and determining the ejection density in every nozzle blocks.

In the aspect configured as mentioned above, on the premise thereof, the resolution by the nozzle pitch of the nozzle array and the target print resolution are different. For this reason, between the liquid droplets ejected by a single nozzle array, by ejecting liquid droplets from the same or other nozzle array, the target print resolution is attained.

Further, the print control part is configured to be printable by changing the ejection density by applying a preset rate thinning when each of a plurality of nozzles in the single nozzle array ejects liquid droplets by relatively moving with respect to a print medium. In other words, in cases where thinning is performed at a certain rate, the thinning is performed during the ejection of liquid droplets by relative moving each nozzle array with respect to the print medium. The thinning is not performed such that a certain nozzle array does not always eject during one pass and another nozzle array always ejects. However, combination of such thinning is not excluded.

Further, this thinning is not applied to a single nozzle array without exception. The nozzle array is divided into a plurality of nozzle blocks, the ejection density is determined each nozzle block, and printing is performed. The nozzle array can be applied to a zigzag arrangement, the nozzle is grouped to divide nozzle blocks, and the ejection density is changed at each nozzle block unit. Further, the change is determined by sequentially changing based on a certain rule.

As mentioned above, when ejecting liquid droplets by relatively moving with respect to the print medium, printing is performed by applying a preset rate thinning every nozzle blocks, and between the liquid droplets ejected from a single nozzle array, liquid droplets are ejected from the same or other nozzle array to complete the printing of the target print resolution. It is not required to interpolate a single print region by a plurality of passes, and it can be completed by the applied ejection density as it is. However, while interpolating a single print region by a plurality of passes, printing can be performed at a preset ejection density as a result.

According to the aspects of the present invention, since it is not to control the unevenness due to the ripple marks by interpolating a single print region by a plurality of passes, not only the trade-off of a print rate and the ripple marks countermeasure but also the ripple marks can be controlled by efficient other methods.

BRIEF DESCRIPTION OF THE DRAWINGS

Referring now to the attached drawings which form a part of this original disclosure.

DETAILED DESCRIPTION OF EXEMPLARY EMBODIMENTS

Hereinafter, an example of the present invention will be explained with reference to drawings.

Figure 1:
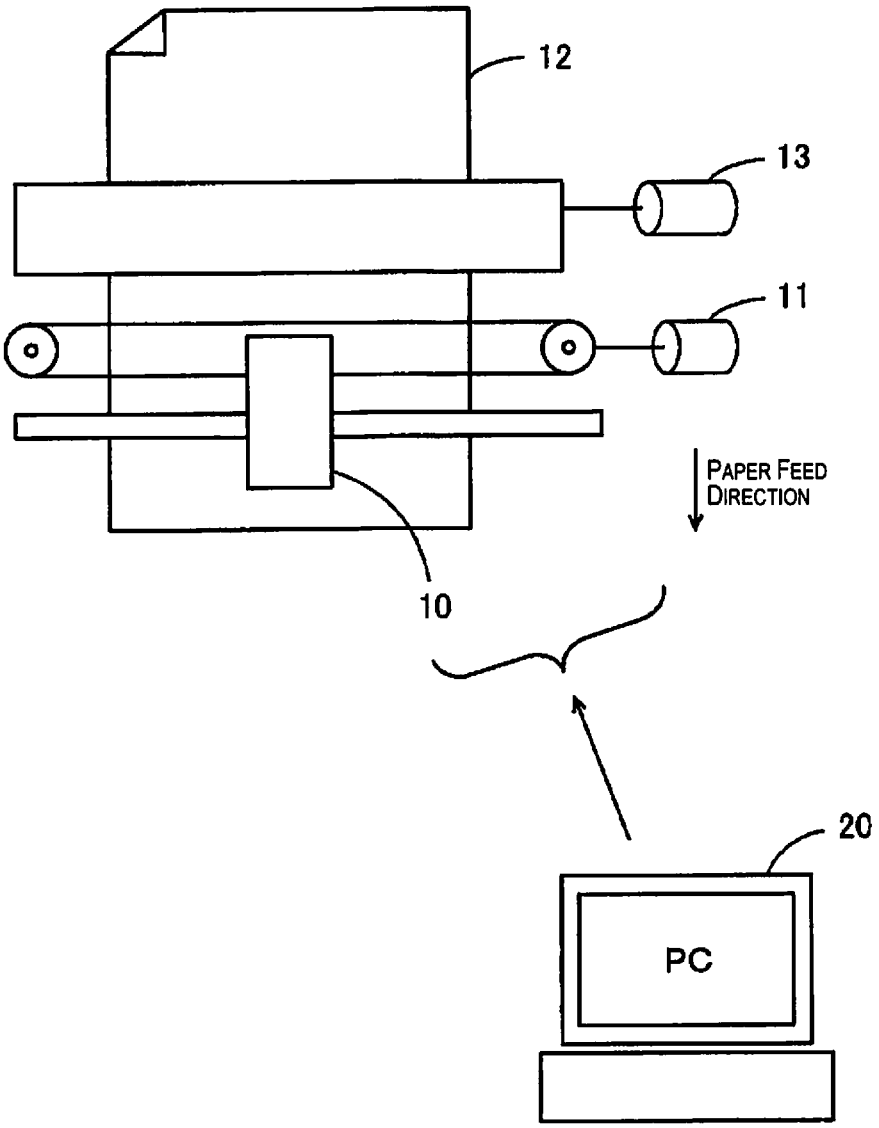
FIG. 1 is a schematic structural view of an ink jet printer of a serial printer to which the present invention is applicable.

FIG. 1 is a schematic structural view of an ink jet printer of a serial printer to which the present invention is applicable.

In this figure, a print head 10 is reciprocally driven as needed by a carriage motor 11 in a width direction perpendicular to a paper feed direction of a print medium 12. A platen motor 13 performs a paper feeding operation of the print medium 12 in a longitudinal direction by a predetermined amount at a predetermined timing. A widthwise driving direction by the carriage motor 11 is a main scanning direction, and a lengthwise driving direction by the platen motor 13 is a sub-scanning direction. In a serial printer, printing is performed by relatively moving a nozzle array for ejecting liquid droplets with respect to the print medium while the print medium is moved in the paper feed direction while reciprocally moving a print head 10 in the main scanning direction.

The print head 10 is provided with a head unit 10*a* that supplies cyan ink, a head unit 10*a* that supplies magenta ink, a head unit 10*a* that supplies yellow ink and a head unit 10*a* that supplies black ink, which are aligned in a width direction of the print medium 12.

Figure 2:
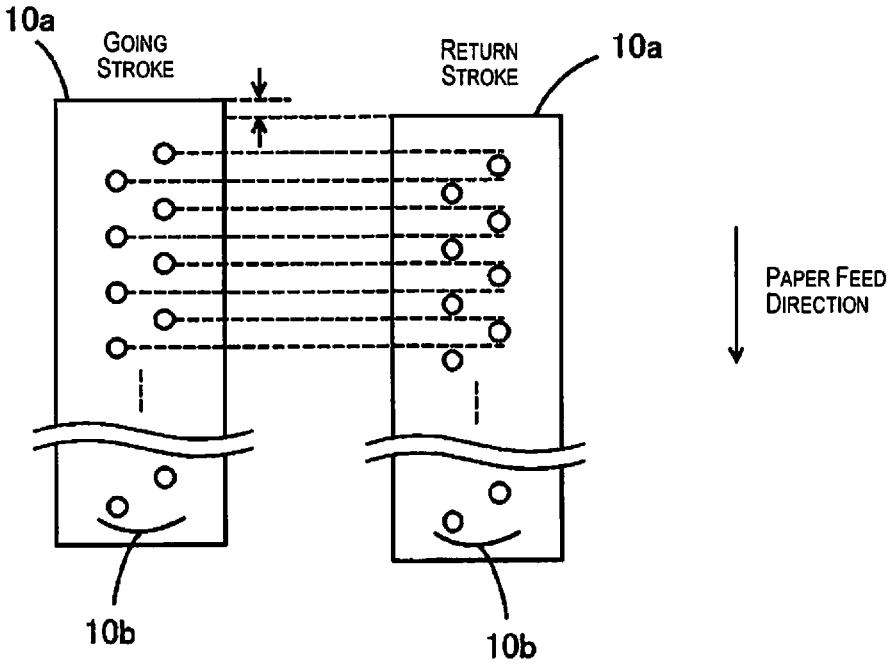
FIG. 2 is a view showing a supplemental relationship of a nozzle array and between lines of the ink jet printer.

FIG. 2 shows a nozzle array of each head unit 10*a*.

In each head unit 10*a*, a nozzle array 10*b* of a zigzag alignment is formed on a side of the head unit 10*a* facing the print medium 12. In this example, the interval of nozzles of the zigzag alignment is set to 600 dpi. However, after printing in a going stroke, in a returning stroke, returning printing is performed with the stroke shifted by 1,200 dpi. That is, although the resolution by the nozzle pitch of a single nozzle array as each head unit 10*a* is 600 dpi, the target print resolution is 1,200 dpi. Both resolutions are different. However, between the liquid droplets ejected in the going stroke of a single nozzle array in the head unit 10*a*, in the returning stroke, the same head unit 10*a* is shifted by 1,200 dpi. Therefore, when liquid droplets are ejected by the nozzle array in the returning stroke, 1,200 dpi, which is a target print resolution, can be attained.

As explained above, the resolution by the nozzle pitch of the nozzle array 10*b* of the head unit 10*a* and the target print resolution are different, and the target print resolution is attained by ejecting liquid droplets between the droplets ejected by the single nozzle array 10*b* with the same nozzle array 10*b*. In a case of a serial printer, the target print resolution is attained by ejecting liquid droplets between the liquid droplets ejected by a single nozzle array 10*b* at a different pass by the same nozzle array 10*b*.

A printing device in which liquid droplets are ejected between liquid droplets ejected by a single nozzle array with the same or another nozzle array is not limited to a serial printer.

Figure 3:
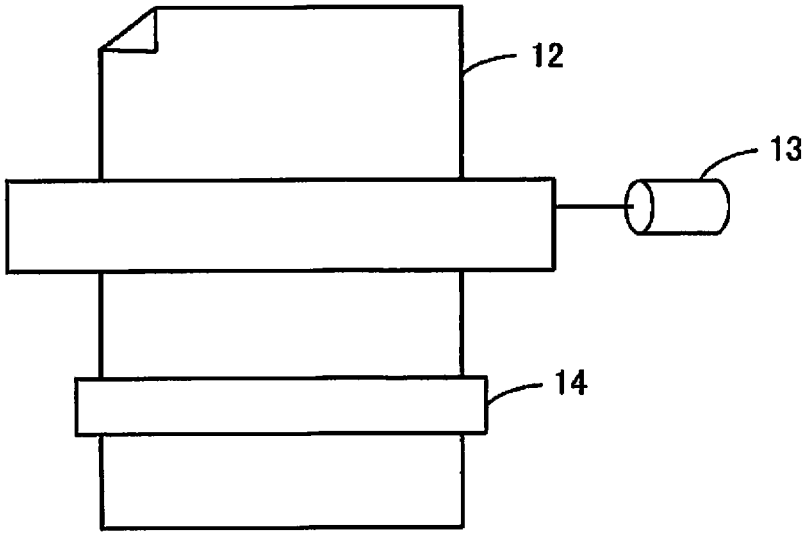
FIG. 3 is a schematic structural view of an ink jet printer of a line printer to which the present invention is applicable.

FIG. 3 is a schematic structural view of an ink jet printer of a line printer to which the present invention is applicable.

In this figure, a line head 14 is fixed so as to traverse the print medium 12 in a direction perpendicular to a paper feed direction of the print medium 12. A platen motor 13 feeds the print medium 12 in the length direction at a predetermined timing by a predetermined amount in the same manner as in a serial printer. In a line printer, no widthwise driving by a carriage motor 11 is performed. However, for convenience sake, the driving direction along the length direction by the platen motor 13 will be referred to as a sub-scanning direction. In a line printer, since the line head 14 is fixed, by moving the print medium in a paper feed direction to cause a relative movement of the nozzle array which ejects liquid droplets with respect to the print medium, printing is performed.

Figure 4:
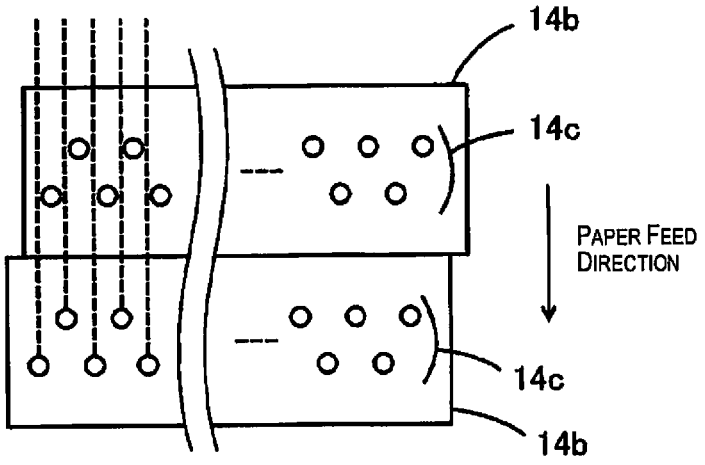
FIG. 4 is a view showing a supplemental relationship of the nozzle array and between lines of the ink jet printer.

FIG. 4 shows a nozzle array of the line head 14

The line head 14 is constituted by two head units 14*b* and 14*b*, and each head unit 14*b* has, at its side facing the print medium 12, a nozzle array 14*c* of a zigzag alignment. In this example, the interval of nozzles of the zigzag alignment is 600 dpi. However, the two head units 14*b* and 14*b* are united with both the head units shifted by 1,200 dpi. In detail, in each of the head units 14*b* and 14*b*, although the resolution by the nozzle pitch of the nozzle array is 600 dpi, both the head units are united in a shifted manner, and therefore the target print resolution of the line head 14 is 1,200 dpi. When rear array another head unit 14*b* ejects liquid droplets between liquid droplets ejected in advance by a single front nozzle array of the head unit 14*b* with shifted by 1,200 dpi, 1,200 dpi, which is a target print resolution, can be attained.

As will be understood from the above, the resolution by the nozzle pitch of the nozzle array 14*c* of the head unit 14*b* and the target print resolution are different, and liquid droplets are ejected from the nozzle array 14*c* of another head unit 14*b* between liquid droplets ejected by the nozzle array 14*c* of a single head unit 14*b*, and thus the target print resolution is attained. In the case of a line printer, a plurality of nozzle arrays 14*c* are provided, and between liquid droplets ejected by a single nozzle array 14*c*, liquid droplets are ejected from another nozzle array 14*c*, and thus the target print resolution is attained.

The ink jet printer is directly or indirectly connected to a PC 20 with wires or wirelessly, and the print data processed by the PC 20 is input to perform printing.

Figure 5:
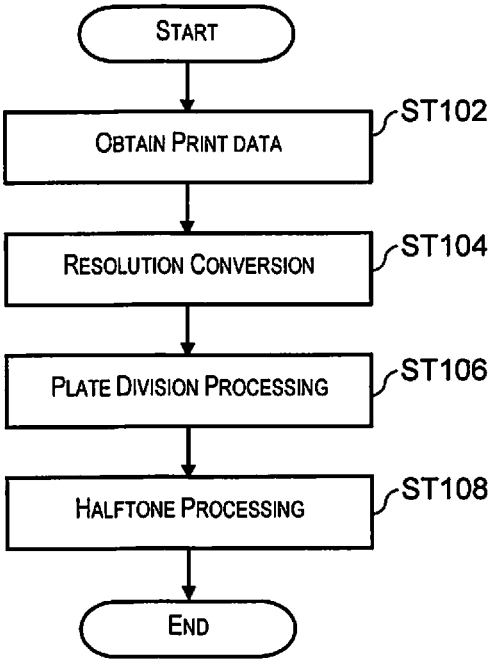
FIG. 5 is a flowchart showing the flow of processing.

FIG. 5 is a flowchart showing the flow of the process.

The PC 20 obtains the data of the input image at step ST102 and performs a resolution conversion in accordance with the target print resolution of the ink jet printer at step ST104. At the next step ST106, the PC 20 performs plate division processing for converting from the RGB (red, green, blue) data into CMYK (cyan, magenta, yellow, black) data corresponding to the ink colors. In this plate division processing, the correspondence relation optimized every print medium has been prepared. At the time of separating every colors, they are multi-graduation data. Therefore, at step ST108, halftone processing is performed so as to be binary data or bit values corresponding to the dot diameter in the case of a multi-dot size. At this stage, halftone results each corresponding to the color inks and the black ink will be created. For convenience of explanation of the following processing, the halftone results at this stage will be referred to as "print data" in the present invention.

The halftone results originally correspond to the final target print resolutions. However, in this example, the nozzle array 10*b* (600 dpi) of the head unit 10*a* in the print head 10 has not reached the target print resolution (1,200 dpi), and printing is performed by separating the going stroke and the returning stroke. For this reason, in the interlace processing at step ST108, the raster data for driving the nozzle array 10*b* (each nozzle #1-#20) of the head unit 10*a* at the going stroke and the raster data for driving the nozzle array 10*b* (each nozzle #1-#20) of the nozzle array 10*b* of the same head unit 10*a* at the returning stroke are created separately.

When printing is performed using the created raster data as it is, the printing quality inevitably deteriorates due to the ripple marks.

Figure 6:
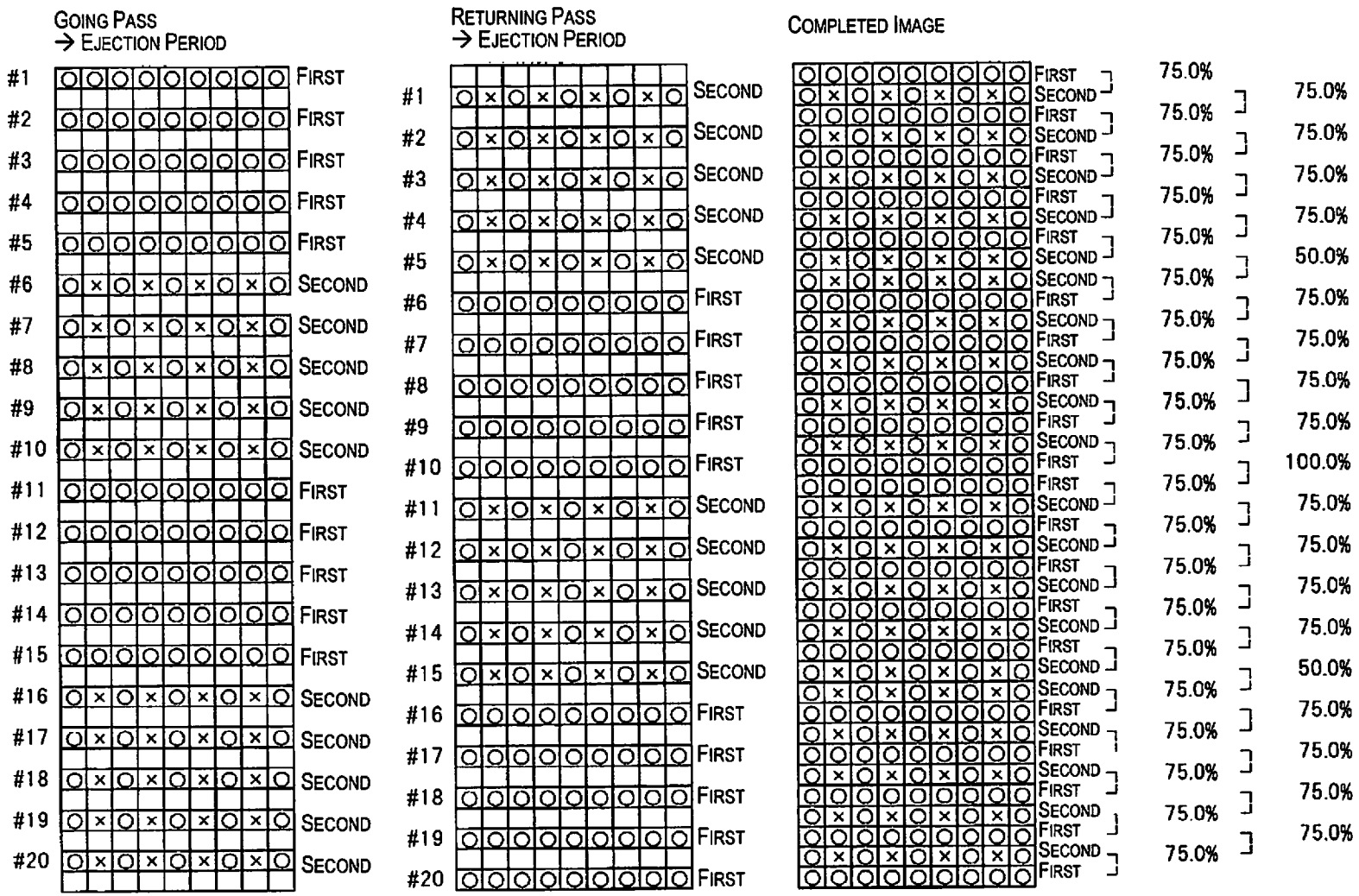
FIG. 6 is a view showing a pattern of a mask for controlling dots ejected from a print head when completing the printing by changing the ejection density.

FIG. 6 is a chart showing patterns of masks for controlling dots ejected from the print head at the time of completing the printing by changing the ejection density. In the mask, "o" denotes data-through, and "x" denotes data-thinning.

Initially, a mask pattern of a going stroke will be explained. The mask patterns for the nozzles #1-#5 and the nozzles #11-#15 are "o," which is 100%-through. In other words, the ejection density is 100%, and no thinning is performed. However, in the mask patterns for the nozzles #6-#10 and the nozzles #16-#20, "o" and "x" are arranged alternately in a continuous manner, which is 50%-through. In other words, they perform 50%-thinning of ejection density. In the case of performing thinning in the present invention as mentioned above, at the time of ejecting liquid droplets by relatively moving with respect to the print medium, thinning is applied at a predetermined rate to change the ejection density, which is not a method in which it becomes continuously through along the so-called orientation direction of the nozzle array or thinning is performed by continuously blocking nozzles. A single nozzle array is divided into a plurality of nozzle blocks, and it is decided to sequentially change the ejection density and the changed ejection density is applied.

The nozzles #1-#5 and nozzles #11-#15 which are 100%-ejection density will be referred to as a first nozzle block, and the nozzle #6-#10 and nozzle #16#20 which are 50%-ejection density will be referred to as a second nozzle block.

In this example, a single nozzle array 10*b* is divided into first nozzle blocks high in ejection density and second nozzle blocks lower in density than the first nozzle block, and the first nozzle block and the second nozzle block are arranged alternately.

Next, a mask pattern of a returning stroke will be explained. Different from the going stroke, the mask patterns for the nozzles #6-#10 and the nozzles #16-#20 are "o," which is 100%-through. In other words, the ejection density is 100%, and no thinning is performed. However, in the mask patterns for the nozzles #1-#5 and the nozzles #11-#15, "o" and "x" are arranged alternately in a continuous manner, which is 50%-through. In other words, they perform 50%-thinning of ejection density.

In detail, in the going stroke and the returning stroke, between the first nozzle blocks in the going stroke, the second nozzle block is arranged in the returning stroke, and between the second nozzle blocks in the going stroke, the first nozzle block is arranged in the returning stroke. In other words, between lines printed by the first nozzle block using the nozzle array of the head unit 10*a* in a going stroke, printing is performed by the second nozzle block using (the same or other) nozzle array of the head unit 10*a* in the returning stroke. Further, between lines printed by the second nozzle block using the nozzle array of the head unit 10*a* in the going stroke, printing is performed by the first nozzle block using (the same or other) nozzle array of the head unit 10*a* in the returning stroke. Therefore, the single nozzle array of the head unit 10*a* is divided into and allotted to first nozzle blocks and second nozzle blocks alternately.

As explained above, when printing using a single nozzle array 10*b* in both the going stroke and the returning stroke, between lines printed by the first nozzle block of the nozzle array 10*b* in the going stroke, printing is performed by the second nozzle block of the nozzle array 10*b* in the returning stroke, and between lines printed by the second nozzle block of the nozzle array 10*b* in the going stroke, printing is performed by the first nozzle block of the nozzle array 10*b* in the returning stroke.

When a pattern in which 100%-ejection density nozzles were continuously arranged by five lines and 50%-ejection density nozzles were continuously arranged by five lines was repeated alternately in a going stroke, the deterioration of the printing quality due to ripple marks was controlled. Naturally, in the returning stroke, since the reverse pattern was merely repeated, the deterioration of the printing quality due to ripple marks was controlled.

Further, after printing by the first nozzle block high in ejection density, when printing by the second nozzle block lower in ejection density is performed to fill between the lines, the mask pattern as a completed image becomes 75% in ejection density as a whole. In the case of not performing such a nozzle block reverse, since the nozzles #1-#5 and the nozzles #11-#15 perform 100%-printing and the nozzles #6-#10 and the nozzles #16-#20 perform 50%-printing, the 100%-ejection density and the 50%-ejection density are repeated every five nozzle lines, causing clear density non-uniformity, which results in largely deteriorated printing quality.

However, although the ejection density is approximately 75%, there exist some portions which do not locally become 75%. In detail, between the $10^{th}$ line and the $11^{th}$ line and between the $30^{th}$ line and the $31^{st}$ line, a 50%-ejection density portion exists, and between the $20^{th}$ line and the $21^{st}$ lines, a 100%-ejection density portion exists. The former leads to a while line and the latter leads to a black line, both of which cause deterioration of printing quality. Next, a modified example for solving such printing quality deterioration will be explained.

Figure 7:
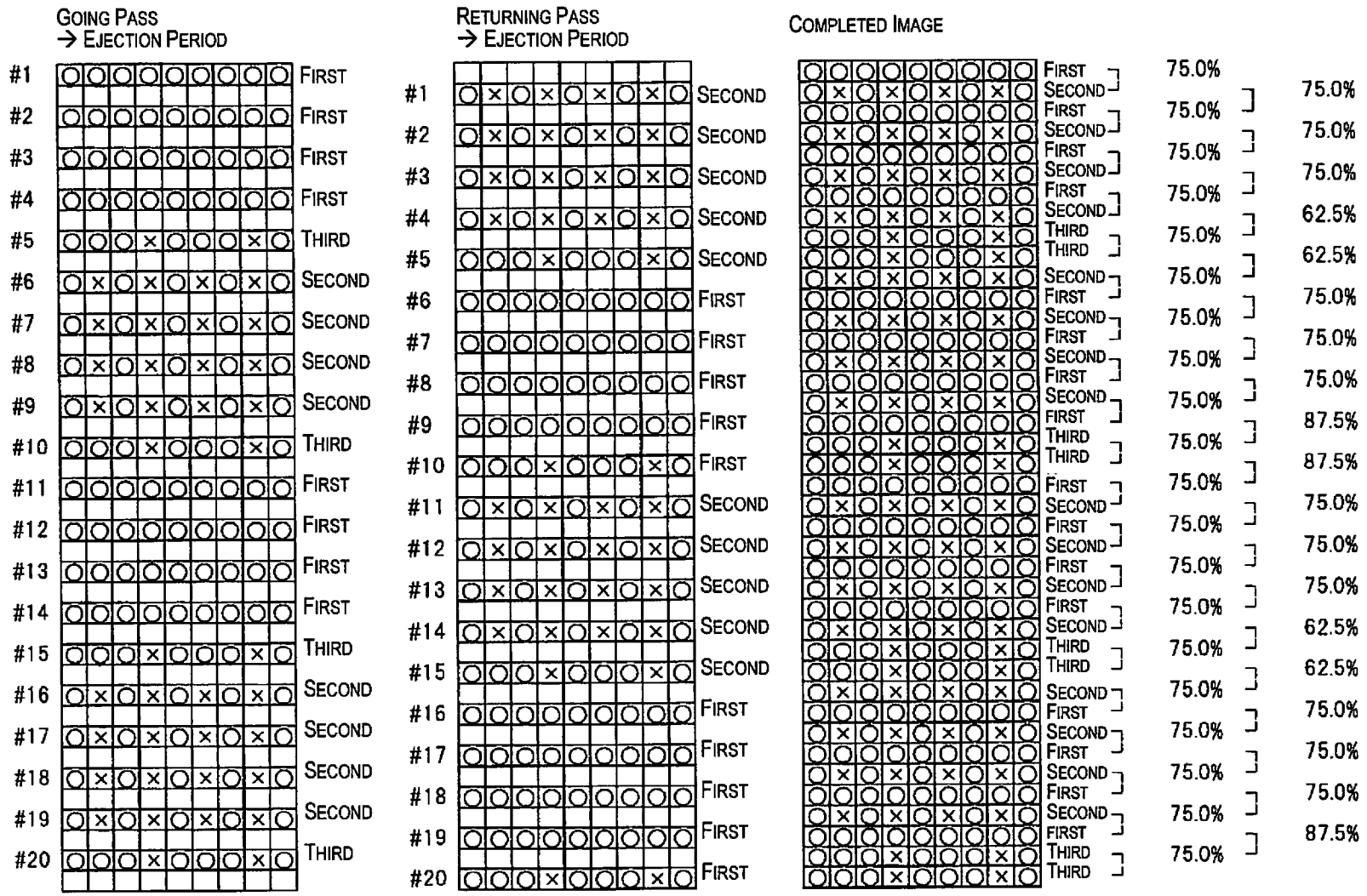
FIG. 7 is a view showing a modified example of a pattern of a mask for controlling dots ejected from a print head when completing the printing by changing the ejection density.

FIG. 7 is a view showing a modified example of a pattern of a mask for controlling dots ejected from a print head when completing printing by changing the ejection density. In the same manner, in the mask, "o" denotes a data-through and "x" denotes data-thinning.

In this modified example, at the boundary of the first nozzle block and the second nozzle block, a third nozzle block is arranged. The ejection density of the third nozzle block is set to be between the ejection density of the first nozzle block and the ejection density of the second nozzle block. It is enough that the nozzle block contains minimum one or more nozzles.

In other words, between the first nozzle block and the second nozzle block, a third nozzle block lower in ejection density than the first nozzle block but higher in ejection density than the second nozzle block is arranged.

Initially, a mask pattern of a going stroke will be explained. The mask patterns for the nozzles #1-#4 and the nozzles #11-#14 are "o," which is 100%-through. In other words, the ejection density is 100%, and no thinning is performed. Next, in the mask patterns for the nozzles #6-#9 and the nozzles #16-#19, "o" and "x" are arranged alternately in a continuous manner, which is 50%-through. In other words, they perform 50%-thinning of ejection density. The mask pattern for the nozzles #5, #10, #15, and #20 which are the third nozzle block is "ooox," which is 75%-through. In other words, the third nozzle block performs 75%-thinning of ejection density, which is between the ejection density of the first nozzle block and the ejection density of the second nozzle block.

Next, the mask patter of the returning stroke will be explained. As for the first nozzle block and the second nozzle block, they are merely completely inverted in the same manner as shown in FIG. 6. In the same manner as in the going stroke, the third nozzle block is arranged at the boundary of the first nozzle block and the second nozzle block.

In the going stroke and the returning stroke, between the first nozzle blocks in the going stroke, the second nozzle block is arranged in the returning stroke, and between the second nozzle blocks in the going stroke, the first nozzle block is arranged in the returning stroke. In other words, between lines printed by the first nozzle block of the nozzle array of the head unit 10*a* in the going stroke, printing is performed by the second nozzle block of (the same or other) nozzle array of the head unit 10*a* in the returning stroke. Further, between lines printed by the second nozzle block of the nozzle array of the head unit 10*a* in the going stroke, printing is performed by the first nozzle block of (the same or other) nozzle array of the head unit 10*a* in the returning stroke.

A pattern in which the nozzles of 100%-ejection density are continuously arranged by four lines, the nozzles of 50%-ejection density are continuously arranged by four lines via the nozzle of 75%-ejection density, and then the nozzle of 75%-ejection density exists is repeated alternately. In this case too, the deterioration of the printing quality due to the ripple marks could be controlled. Naturally, since the reverse pattern is repeated in the returning stroke, the deterioration of the printing quality due to the ripple marks could be controlled.

Further, after printing by the first nozzle block high in ejection density, printing by the second nozzle block lower in ejection density is performed to fill between lines, and therefore the mask pattern as a completed image becomes 75% in ejection density as a whole.

In the example shown in FIG. 7, there existed portions which did not become 75%. That is, between the $10^{th}$ line and the $11^{th}$ line, and between the $30^{th}$ line and the $31^{st}$ line, a 50%-ejection density portion arouse, and between the $20^{th}$ line and the $21^{st}$ line, a 100%-ejection density portion arouse. However, by employing the third nozzle block, between the $8^{th}$ line and the $9^{th}$ line, and between the $10^{th}$ line and the $11^{th}$ line, the ejection density became 62.5%, which increased in ejection density as compared with 50%. Similarly, between the $28^{th}$ line and the $29^{th}$ line, and between the $30^{th}$ line and the $31^{st}$ line, the ejection density became 62.5%, which could increase the ejection density than 50%. This lowers the possibility of occurrence of while lines. On the other hand, between the $18^{th}$ line and the $19^{th}$ line, and between the $20^{th}$ line and the $21^{st}$ line, the ejection density was 87.5%. However, since the ejection density of 100% in the example shown in FIG. 7 approached to the side of 75%, the possibility of occurrence of black lines becomes lower.

As mentioned above, by arranging the third nozzle block having the ejection density between that of the first nozzle block and that of the second nozzle block at the boundary of the first nozzle block high in ejection density and the second nozzle block low in ejection density, in addition to control the deterioration of the printing quality due to the ripple marks, it becomes possible to control while lines and black lines.

In the meantime, when the ejection density becomes less than 100%, it can be said that the printing density decreases. The countermeasure thereof will be shown.

Figure 8A:
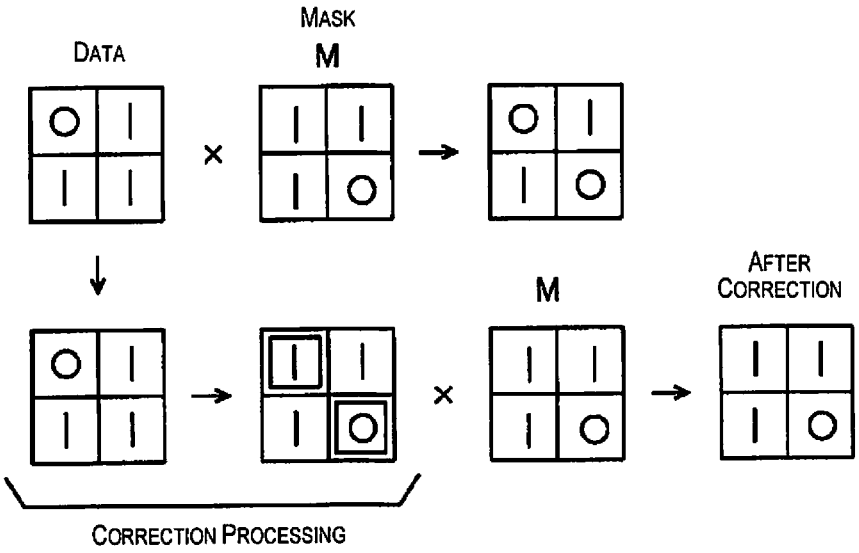
FIGS. 8A and 8B are views explaining the dot transfer to maintain the printing density before and after the thinning.
Figure 8B:
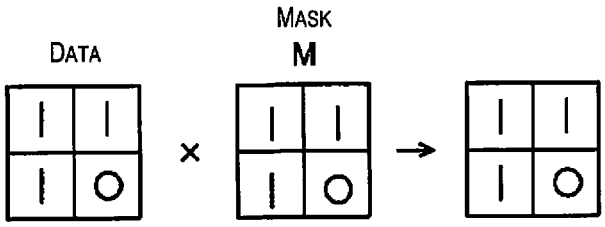

FIGS. 8A and 8B are views explaining the dot transfer to maintain the printing density before and after the thinning.

For example, considering the raster data of 2×2 dots as shown in FIGS. 8A and 8B, printing having a density corresponding to the 75% ejection density can be roughly expected. In this case, if the mask M of the 75% ejection density is applied, in the case FIG. 8B, the printing density becomes 75%, and in the case FIG. 8A, the printing density becomes 50%, which are different in result and lower the printing density itself. In this figure, as to the data, "o" denotes that there is no dot, and "|" denotes that there is a dot. Further, as to the mask, "|" denotes the maintenance of dot, and "o" denotes the elimination of dot.

Therefore, judging two conditions, whether there previously exists data for ejecting a liquid droplet at a position of a mask for thinning a pixel and whether there exists data for not ejecting a liquid droplet at a position for not thinning a pixel, if both the judged results are YES, a process for replacing the data of the pixel to be thinned with the data of the pixel not to be thinned can be added. In other words, when lowing the ejection density to, e.g., 75%, the data for ejecting a liquid droplet is amended so that the printing density before lowering the ejection density is maintained at the printing density after lowering the ejection density.

Concretely, by judging the two conditions of FIG. 8A, it becomes possible. However, a process for always error-diffusing the positional data of the pixel to be thinned to the surrounding pixel can be added. Needless to say, it can be configured such that the data is replaced with the closest pixel for not ejecting a liquid droplet outside of the 2×2 frame.

The above explanation was directed to a printing device using ink, but the concept of printing is not limited to the case in which letters and/or patterns are drawn on a paper using ink. The print medium can be various objects including a most basic paper, a resin sheet, a metal sheet, or a surface of a three-dimensional object, and the ink is not limited to an object for expressing colors and can be various kinds of liquids to be ejected to give any functions. Therefore, in the present invention, the printing device according to the present invention is used synonymously with various kinds of liquid droplet ejection devices, and the ink is used synonymously with various kinds of liquid droplets.

In this example, the serial printer denotes a printing device for printing a single character at a time (JIS X0012-1990).

As to a dot printer, "a single character" denotes "a character or image expressed by a plurality of dots corresponding to a single character." A line printer denotes a printing device for printing characters of a single line as a unit (JIS X0012-1990). Here, in a dot printer, "characters of a single line" denotes "characters or images expressed by a plurality of dots corresponding to characters of a single line." Further, an ink jet printer denotes a nonimpact printer by which characters are formed on a paper by ejecting ink particles or small droplets (JIS X0012-1990). This is one kind of dot printers for printing characters or images expressed by a plurality of dots by ejecting ink particles or small droplets.

In the aforementioned example, the structure and functions as a printing device were mainly explained, but the structure and functions as a printing method were also explained by the disclosure of steps of the functions.

Needless to say, the present invention is not limited to the aforementioned example. For a person skilled in the art, it goes without saying that the followings are disclosed as one example of the present invention:

- arbitrarily changing the combination of the mutually replaceable material, structure, etc., disclosed in the example and applying;
- arbitrarily replacing the material, structure, etc., disclosed in the example with the material, structure, etc., which are not disclosed in the example, and are publicly known technology and mutually replaceable;
- arbitrarily replacing the material, structure, etc., disclosed in the example with the material, structure, etc., which are not disclosed in the example, but considered to be replaced with the material, structure, etc., based on a publicly known technology, etc., by the person skilled in the art.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts.

Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A printing device in which printing is performed by relatively moving a nozzle array for ejecting a liquid droplet with respect to a print medium, a resolution by a nozzle pitch of the nozzle array is lower than a target print resolution, and between liquid droplets ejected by a single nozzle array, liquid droplets are ejected from the same or another nozzle array to attain the target print resolution, wherein each of a plurality of nozzles in the single nozzle array is printable by changing an ejection density by applying a preset rate thinning when ejecting liquid droplets by relatively moving with respect to the print medium, and wherein the printing device is provided with a print control part configured to perform printing by dividing the single nozzle array into a plurality of nozzle blocks and determining the ejection density in every nozzle blocks.

2. The printing device according to claim 1, wherein the print control part is configured to divide the single nozzle array into a first nozzle block high in the ejection density and a second nozzle block lower in the ejection density than the ejection density of the first nozzle block and to arrange the first nozzle block and the second nozzle block alternately.

3. The printing device according to claim 2, wherein the print control part is configured to arrange a third nozzle block having the ejection density lower than the ejection density of the first nozzle block but higher than the ejection density of the second nozzle block between the first nozzle block and the second nozzle block.

4. The printing device according to claim 2, wherein the print control part is configured to, when printing is performed by the same nozzle array as the single nozzle array or another nozzle array, perform printing by a second nozzle block by the same or another nozzle array between printing lines by a first nozzle block of the single nozzle array, and to perform printing by the first nozzle block of the same or another nozzle array between printing lines by the second nozzle block of the single nozzle array.

5. The printing device according to claim 1, wherein the print control part is configured to correct data that ejects the liquid droplets so that a printing density after lowering the ejection density becomes substantially the same printing density before lowering the printing density when lowering the ejection density.

6. The printing device according to claim 1, wherein the printing device is a serial printer having a print head configured and arranged to eject the liquid droplets by the single nozzle array in different passes between the liquid droplets ejected from the single nozzle array to attain the target print resolution.

7. The printing device according to claim 1, wherein the printing device is a line printer having a print head including a plurality of nozzle arrays configured and arranged to eject the liquid droplets from one nozzle array between the liquid droplets ejected by another nozzle array to attain the target print resolution.

8. A printing method in which printing is performed by relatively moving a nozzle array for ejecting a liquid droplet with respect to a print medium, a resolution by a nozzle pitch of the nozzle array is lower than a target print resolution, and between liquid droplets ejected by a single nozzle array, liquid droplets are ejected from the same or another nozzle array to attain the target print resolution, wherein each of a plurality of nozzles in the single nozzle array is printable by changing an ejection density by applying a preset thinning when ejecting the liquid droplets by relatively moving with respect to the print medium, and wherein the single nozzle array is divided into a plurality of nozzle blocks, the ejection density is determined in every nozzle block, and printing is performed.

9. A printing device in which printing is performed by moving a head having a nozzle array for ejecting liquid droplets in a main scanning direction with respect to a print medium and relatively moving the head and the print medium in a sub-scanning direction which is a direction intersecting with the main scanning direction, the printing device comprising:

a control portion configured to divide the nozzle array into a plurality of nozzle blocks and to determine an ejection density in every nozzle blocks, wherein the control portion is configured to perform determination of the ejection density in every single scanning of the head in the main scanning direction; and after ejecting the liquid droplets at a first ejection density by scanning the head in the main scanning direction, relatively move the head and the print medium in the sub-scanning direction by about a half amount of a nozzle pitch of the single nozzle array, and further scan the head in the sub-scanning direction to eject the liquid droplets at a second ejection density different from the first ejection density.

10. The printing device according to claim 9, wherein the control portion is configured to divide the single nozzle array into a first nozzle block high in the ejection density and a second nozzle block lower in the ejection density than the ejection density of the first nozzle block and to arrange the first nozzle block and the second nozzle block alternately.

11. The printing device according to claim 10, wherein the control portion is configured to arrange a third nozzle block having the ejection density lower than the ejection density of the first nozzle block but higher than the ejection density of the second nozzle block between the first nozzle block and the second nozzle block.

12. The printing device according to claim 9, wherein the control portion is configured to correct data that ejects the liquid droplets so that a printing density after lowering the ejection density becomes substantially the same printing density before lowering the printing density when lowering the ejection density.

* * * * *